United States Patent [19]

Tamm

[11] 4,336,128

[45] Jun. 22, 1982

[54] COMBUSTION OF PYROLYZED CARBON CONTAINING SOLIDS IN STAGED TURBULENT BED

[75] Inventor: Paul W. Tamm, Oakland, Calif.

[73] Assignee: Chevron Research Company, San Francisco, Calif.

[21] Appl. No.: 268,938

[22] Filed: Jun. 1, 1981

[51] Int. Cl.[3] ..... C10G 1/00

[52] U.S. Cl. ..... 208/11 R; 208/8 R; 201/31

[58] Field of Search ..... 208/11 R, 8 R, 127; 201/31, 34

[56] References Cited

U.S. PATENT DOCUMENTS

| | | | |
|---|---|---|---|
| 4,148,710 | 4/1979 | Burton | 201/31 X |
| 4,199,432 | 4/1980 | Tamm et al. | 208/11 R X |
| 4,243,489 | 1/1981 | Green | 208/11 R X |

*Primary Examiner*—Delbert E. Gantz
*Assistant Examiner*—G. Caldarola
*Attorney, Agent, or Firm*—D. A. Newell; S. R. LaPaglia; J. W. Ambrosius

[57] ABSTRACT

Process for burning a pyrolyzed carbon containing solid in a staged turbulent bed to provide hot heat transfer material for use in pyrolyzing additional carbon containing solids.

12 Claims, 1 Drawing Figure

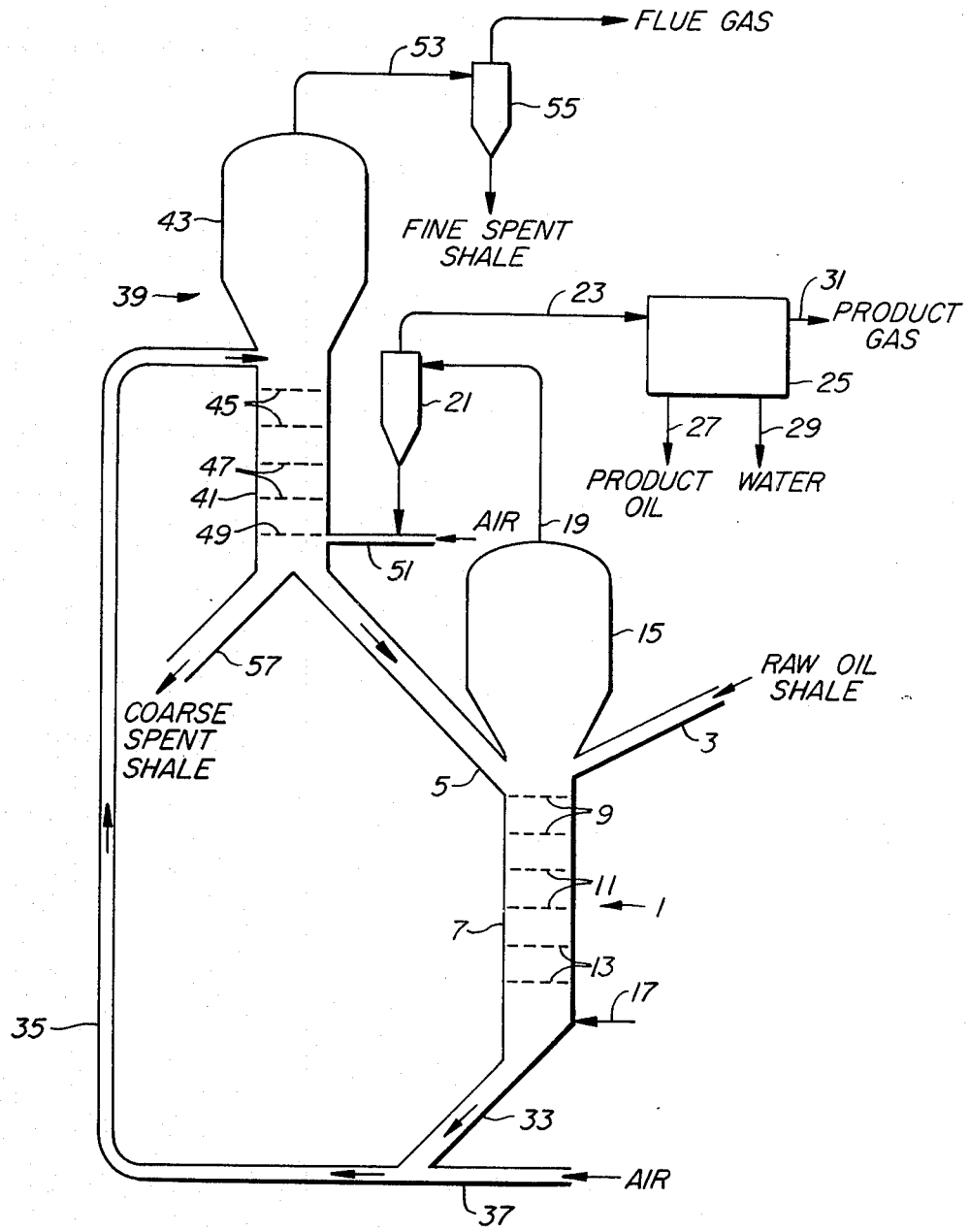
FLUE GAS
53
55
FINE SPENT SHALE
43
39
23
31
PRODUCT GAS
25
21
27
29
PRODUCT OIL
WATER
45
47
41
49
AIR
19
51
15
57
RAW OIL SHALE
COARSE SPENT SHALE
3
5
9
11
1
7
13
17
35
33
AIR
37

COMBUSTION OF PYROLYZED CARBON CONTAINING SOLIDS IN STAGED TURBULENT BED

BACKGROUND OF THE INVENTION

Following the pyrolysis of certain carbonaceous materials, such as oil shale, tar sand, coal, and diatomaceous earth, to extract volatile components, such as oil and hydrocarbon gases, the solid which remains is referred to as "pyrolyzed carbon containing material" or in the case of oil shale—"retorted oil shale". This solid contains carbonaceous residue which may be burned to yield heat energy. The heat recovered from the combustion may be used to supply heat for the pyrolysis of fresh oil shale or other carbonaceous material in the pyrolysis process.

In the case of oil shale, the ash that remains after the combustion of the carbonaceous residue present in retorted shale is called "burned shale". In some retorting processes the burned shale serves as a "heat carrier material" to directly supply the heat for retorting of more raw oil shale. In such process schemes retorted shale is combusted in a separate vessel, and the hot, burned shale is recycled to the retorting vessel and mixed with the raw oil shale. Heat is transferred between the two solids, and the mixture reaches a uniform temperature. At this temperature the oil is released from the raw oil shale. See for example U.S. Pat. No. 4,199,432.

During retorting and combustion of oil shale to produce product vapors and heat, respectively, the physical integrity of the shale particles is changed, and a substantial amount of fine grained shale is produced which is not suitable for use as the recycle heat carrier material. Therefore, it is necessary to separate this fine material prior to recycling the burned shale.

The solids withdrawn from the retort and sent to the combustor are a mixture of freshly retorted shale and cooled recycle shale. The recycle shale contains little or no carbonaceous residue.

When burning the carbonaceous residue in retorted oil shale sufficient residence time must be provided in the combustor to assure both reasonably complete combustion and thermal equilibration between the hot burning particles and the cooler recycle particles. In processes using a liftpipe (entrained bed) combustor, a very long liftpipe is required to achieve a residence time of even a few seconds in the combustion zone.

The present invention is directed to an improved process for burning the pyrolyzed particulate carbon containing material and for separating out fine hot particles prior to recycling the remaining hot particles back into the pyrolysis vessel.

SUMMARY OF THE INVENTION

The present invention concerns a process for producing heat from particulate pyrolyzed carbon containing solids containing a mixture of various size particles which comprises the steps of (a) introducing the pyrolyzed carbon containing solids into the upper portion of a generally vertically oriented dense phase combustion zone through which the solids pass downward as a continuous moving bed of material, said dense phase combustion zone being characterized by the presence of a plurality of dispersing elements so disposed as to limit gross vertical backmixing of the solids passing downward therethrough;

(b) burning the carbonaceous material remaining on the pyrolyzed solids as they move downward through the dense phase combustion zone by introducing an oxidizing gas into the bottom of the dense phase combustion zone and withdrawing combustion gases from the upper portion of the zone;

(c) passing the flow of oxidizing gas in a generally countercurrent manner to the downward moving solids at a velocity sufficient to entrain a fine fraction of the particles below a preselected size, sufficient to fluidize an intermediate size fraction, and insufficient to entrain or fluidize a coarse fraction, whereby the fine fraction is carried upward with the flow of gas as entrained particles and the intermediate and coarse fractions pass downward; and (d) withdrawing the entrained fine fraction with the gas leaving the upper portion of the dense phase combustion zone and separately withdrawing the intermediate and coarse fractions from the lower part of the dense phase combustion zone.

The process of this invention is particularly advantageous when the pyrolyzed carbon containing solid is retorted oil shale.

In one preferred embodiment of the invention the residual carbonaceous material in the retorted oil shale is partially burned prior to introduction into the dense phase combustion zone in a dilute phase combustion zone by entraining the oil shale particles in an entraining gas containing oxygen, said gas having a superficial velocity in excess of the terminal velocity of the particles of retorted oil shale.

As used herein, the phrase "fine particles of burned shale" or "fine fraction" refers to particles of a size unsuitable for recycling as heat transfer material. Usually particles smaller than about 100 to 200 mesh size (Tyler standard), i.e., about 75 to 150 microns in diameter, are not suitable for this purpose in the retorting process. Therefore, particles below this range are removed as entrained particles in the gas passing through the dense phase combustion zone. By exclusion "coarse fraction" and "intermediate fraction" refer to particles larger than about 200 mesh size. It should be understood that the terms fine, intermediate and coarse are relative terms, the size of which may vary somewhat depending on the exact details of the process scheme. Thus, in process schemes where particles smaller than 200 mesh may be tolerated, the term "fines" may include particles of a smaller mesh size. Likewise, under other circumstances particles of larger minimum mesh size may be desired, and the definition of "fine particles" will be adjusted accordingly.

The term "intermediate" refers to particles of a size which will fluidize, but not become entrained, when subjected to the countercurrent flow of gas passing through the dense phase combustion zone. The term "coarse" refers to particles too large to either fluidize or become entrained in a countercurrent flow of gas of a velocity equal to that being employed. Both the intermediate and coarse fractions pass downward with the moving bed of solids through the dense phase combustion zone in opposition to the direction of the gas flow. Although the residence time of the intermediate and coarse fractions may not be the same through this combustion zone, the dispersing elements serve to increase the residence time of the coarse particles to about 50–90% of the average residence time of all of the particles.

BRIEF DESCRIPTION OF DRAWING

The drawing is a schematic representation of an oil shale extraction process utilizing one embodiment of this invention.

DETAILED DESCRIPTION OF THE INVENTION

Referring to the drawing, crushed raw oil shale is introduced into retort 1 via feed conduit 3. Recycled burned shale serving as heat transfer material is introduced into the retort through conduit 5. The lower portion 7 of the retort is equipped with multiple perforated plates 9, 11 and 13 which serve as dispersing elements. The upper portion 15 of retort 1 is of a larger diameter than the lower portion 7 in order to serve as a disengaging section for entrained solids. A stripping gas, preferably steam or in some cases recycled product gas or other inert gas, is introduced into the bottom of the retort through conduit 17. The stripping gas and retorted oil vapors flow upward through the retort and are removed via conduit 19. Entrained fine particles of retorted oil shale are separated from the product vapors and stripping gas by a separation device 21. The separation device may be a hot cyclone, hot filter, electrostatic precipitator, or a combination of the described devices. The product vapors and stripping gas pass via conduit 23 into a product recovery zone 25 in which the shale oil and water are recovered. The oil is recovered for further processing through outlet 27 and water is withdrawn via conduit 29 for disposal and for recycling as steam. Product gas exits by way of outlet 31.

Referring again to the retort 1, solids are removed from the bottom of the lower portion 7 of the retort by means of conduit 33 and pass into a dilute phase combustion pipe 35 into which an entraining gas, usually air, is introduced by means of inlet 37. The carbonaceous residue in the retorted shale is partially burned in the dilute phase combustion pipe 35, raising the temperature of the entrained solids. The partially burned oil shale is discharged into a dense phase combustion chamber 39 having a lower portion 41 and an upper portion 43. The lower portion contains multiple perforated plates 45, 47, and 49 which serve as dispersing elements. These dispersing elements limit gross vertical backmixing of the solids, limit slugging, and increase the residence time of the nonfluidizable coarse particles passing through the combustion chamber. The presence of the dispersing elements increases the residence time of the nonfluidizable particles to between about 50–90% of the average residence time for all particles passing through the dense phase combustion chamber.

Air and entrained fine particles of retorted shale from separation device 21 are introduced into the lower portion 41 of the dense phase combustion chamber 39 by way of conduit 51. Conduit 51 preferably is sized so that some combustion of the entrained particles occurs prior to entry into the lower portion 41 of the dense phase combustion chamber. The air from conduit 51 passes upward in countercurrent flow to the downward moving bed of burning oil shale entraining fine particles of burned shale. The upper portion 43 of the combustion chamber serves as a disengager for entrained solids having a particle size larger than a preselected minimum. Flue gas carrying fine entrained particles of burned shale pass via conduit 53 to separation device 55 where the fines are separated from the flue gas. Intermediate and coarse particles of burned shale are recycled by way of conduit 5 back into retort 1. Burned shale in excess of that needed for recycle is disposed of through outlet 57.

Retorted shale and recycled burned shale entering the dilute phase combustion zone are pneumatically entrained in a gas stream, usually air, and part of the residual carbonaceous material remaining in the shale is burned. Shale particles entering the dilute phase combustion chamber generally contain a wide range of particle sizes. In processes using recycled burned shale as a heat transfer material, maximum particle size may be about $\frac{1}{4}$ inch. In order to prevent choking of the dilute phase combustion chamber when conveying particles of this size the entraining gas should have a velocity in the range of from about 50 feet per second to about 150 feet per second with a preferred range being of from about 80 feet per second to about 100 feet per second. Since the carbonaceous residue is only partially burned in this zone, the chamber (usually a liftpipe) need only be long enough to carry out the desired degree of combustion and temperature equilibration between the recycle shale and the burning retorted shale. However, the liftpipe must be long enough to raise the burning shale to the level of the inlet into the dense phase combustion zone.

As already noted, the shale moves through the dense phase combustion zone as a downward moving bed of material partially fluidized by a countercurrent flow of gas. These particles having a minimum fluidization velocity greater than the velocity of the countercurrent gas flow (coarse particles), will pass downward in this combustion zone at a somewhat faster rate than the fluidized particles. Fine particles having a terminal velocity less than the velocity of the countercurrent gas flow will be entrained and carried upward with the gas.

As used herein, the phrase "minimum fluidization velocity" refers to the minimum superficial velocity of a gas passing through a bed of particles of given size required to cause the bed to behave like a fluid. "Terminal velocity" refers to the maximum velocity attained by a particle falling in a very long column of stagnant air. "Entrained particle" refers to a particle subjected to a gas flow whose velocity is in excess of the particle's terminal velocity.

An essential feature of the dense phase combustion zone lies in limiting the maximum bubble size in the gas phase and limiting vertical backmixing of the downward moving shale to produce stable, substantially plug flow conditions of both gas and solids through this zone. An advantage of this design is that relatively uniform residence times for all particle sizes are achieved in the combustion zone. This assures substantially complete combustion of the carbonaceous residue and thermal equilibration between the hot burning particles and the cooler recycle particles. Residence times measured in minutes, rather than seconds (characteristic of the dilute phase section), are attainable. The use of dispersing elements for substantially limiting gross vertical backmixing of the solids also permits a reduction in the size of the combustion zone required for a given mass throughput, since the chance for removing partially burned shale with the completely burned shale is reduced. The dispersing elements for limiting bubble size and increasing the residence time of the coarse particles may take the form of barriers or flow distributors and may, for example, include spaced horizontal perforated plates, bars, screens, packing, or other suitable internals.

Although gross backmixing in the dense phase combustion zone should be avoided, localized mixing is desirable in that it insures maximum heat transfer between the hot burning particles and the cooler recycle particles. The degree of backmixing is, of course, dependent on many factors, but is primarily dependent upon the particular dispersing elements disposed within the zone. The advantages of this invention cannot be achieved with a conventional fluidized bed due to the gross top to bottom mixing and the difference in residence times of the disparate particle sizes.

The preferred way of carrying out combustion in the dense phase combustion zone is by using air, or another oxygen containing gas, to supply the countercurrent gas flow. Combustion is preferably carried out in the superstoichiometric mode, i.e., more than sufficient oxygen is present to insure complete combustion of the residual carbonaceous material. The velocity of the upward gas flow is usually in the range of from about 1 foot per second to about 5 feet per second and preferably in range of from about 1 to about 3 feet per second. This velocity is sufficient to entrain fine particles of about 200 mesh or smaller and carry them out of the top of the combustion zone along with the flue gas. Larger particles (intermediate and coarse sizes) are removed from the bottom of the combustion zone for recycling and for disposal.

Although the process of this invention is most advantageously used in an oil shale retorting process using recycled burned shale as a heat transfer material, the process is not limited to that mode of operation. The process herein described can also be used to heat other types of heat transfer material such as, for example, ceramic compositions, sand, alumina, iron, steel and the like. Even in processes using burned shale as the principal heat transfer material, it is often necessary to add supplemental heat transfer material to the system. In addition, the hot flue gases exiting the top of the dense phase combustion zone could be used in retorting raw oil shale if such is desired, or alternatively the combustion could be also used to produce steam. Thus various alternative embodiments and permutations of the invention may be conceived by one skilled in the art.

What is claimed is:

1. A process for producing heat from particulate pyrolyzed carbon containing solids containing a mixture of various size particles which comprises the steps of:

(a) introducing the pyrolyzed carbon containing solids into the upper portion of a generally vertically oriented dense phase combustion zone through which the solids pass downward as a continuous moving bed of material, said dense phase combustion zone being characterized by the presence of a plurality of dispersing elements so disposed as to limit gross vertical backmixing of the solids passing downward therethrough;

(b) burning the carbonaceous material remaining on the pyrolyzed solids as they move downward through the dense phase combustion zone by introducing an oxidizing gas into the bottom of the dense phase combustion zone and withdrawing combustion gases from the upper portion of the zone;

(c) passing the flow of oxidizing gas in a generally countercurrent manner to the downward moving solids at a velocity sufficient to entrain a fine fraction of ash particles below a preselected size, sufficient to fluidize an intermediate size fraction, and insufficient to entrain or fluidize a coarse fraction, whereby the fine fraction is carried upward with the flow of gas as entrained particles and the intermediate and coarse fractions pass downward; and (d) withdrawing the entrained fine fraction with the gas leaving the upper portion of the dense phase combustion zone and separately withdrawing the intermediate and coarse fractions from the lower part of the dense phase combustion zone.

2. Process of claim 1 wherein the intermediate and coarse fractions of step (d) are used as heat transfer particles in pyrolyzing other carbon-containing solids.

3. Process of claim 1 wherein prior to entering the dense phase combustion zone the carbonaceous residue in the pyrolyzed solids is partially burned in a dilute phase combustion zone by entraining said solids in an entraining gas containing oxygen, said gas having a superficial velocity in excess of the terminal velocity of the particles of pyrolyzed carbon containing solids.

4. Process of claim 3 wherein the entraining gas passing through the dilute phase combustion zone has a superficial velocity of from about 50 feet per second to about 150 feet per second.

5. Process of claim 4 wherein said superficial velocity is in the range from about 80 feet per second to about 100 feet per second.

6. Process of claim 1 wherein the entraining gas passing through the dense phase combustion zone has a superficial velocity in the range of from about 1 foot per second to about 5 feet per second.

7. Process of claim 6 wherein said superficial velocity is in the range from about 1 foot per second to about 3 feet per second.

8. Proccess of claim 1 wherein the particles of carbon containing solids prior to combustion have a diameter of not more than about 0.5 inch.

9. Process of claim 8 wherein the particles have a diameter of not more than about 0.25 inch.

10. Process of claim 1 wherein at least part of the fine fraction of pyrolyzed carbon containing solids is introduced as a separate feed stream into the bottom of the dense phase combustion zone.

11. Proccess of claim 10 wherein the separate feed stream containing said fine fraction is partially burned in a dilute phase combustion zone prior to introduction into the dense phase combustion zone.

12. The process of claim 1 wherein the carbon containing solid is oil shale.

* * * * *